US007231692B2

(12) United States Patent
Harada

(10) Patent No.: US 7,231,692 B2
(45) Date of Patent: Jun. 19, 2007

(54) DAMPING MECHANISM OF OPENING AND CLOSING MEMBER, AND CONTAINER HOLDER AND AUTOMOBILE DOOR INCLUDING THE SAME

(75) Inventor: Akinori Harada, Sagamihara (JP)

(73) Assignee: Nifco Inc., Yokohama (JP)

( * ) Notice: Subject to any disclaimer, the term of this patent is extended or adjusted under 35 U.S.C. 154(b) by 585 days.

(21) Appl. No.: 10/254,979

(22) Filed: Sep. 26, 2002

(65) Prior Publication Data

US 2003/0071047 A1 Apr. 17, 2003

(30) Foreign Application Priority Data

Oct. 11, 2001 (JP) ..... 2001-313503

(51) Int. Cl.
*B65D 43/22* (2006.01)
*B65D 43/24* (2006.01)

(52) U.S. Cl. ..... 16/345; 220/835; 220/836

(58) Field of Classification Search ..... 16/85, 16/86 R, 86 C, 80, DIG. 10, DIG. 17, 337, 16/343, 345, 376, 377, 273; 248/309.1, 311.2; 49/98, 104, 119, 150, 286, 445; 224/926, 224/275, 539; 220/815, 836
See application file for complete search history.

(56) References Cited

U.S. PATENT DOCUMENTS 5,079,797 A * 1/1992 Ohshima et al. ..... 16/82
5,520,313 A * 5/1996 Toshihide ..... 224/539
5,620,122 A * 4/1997 Tanaka ..... 224/275
5,673,459 A * 10/1997 Baghdasarian ..... 16/308
5,718,405 A * 2/1998 Adachi ..... 248/311.2
5,887,930 A * 3/1999 Klein ..... 296/37.12
5,904,411 A * 5/1999 Hayakawa ..... 312/319.2
6,065,729 A * 5/2000 Anderson ..... 248/311.2
6,470,627 B2 * 10/2002 Fukuo ..... 49/260
6,609,631 B2 * 8/2003 Asami ..... 220/817
6,662,405 B2 * 12/2003 Vitry ..... 16/355
6,715,727 B2 * 4/2004 Sambonmatsu ..... 248/311.2
2001/0014993 A1 * 8/2001 Orita ..... 16/82
2001/0052524 A1 * 12/2001 Ichimaru et al. ..... 220/815

FOREIGN PATENT DOCUMENTS

JP 362-026145 A * 2/1987
JP 2000-274143 * 10/2000
JP 2002-178818 6/2002

* cited by examiner

*Primary Examiner*—Robert J. Sandy
*Assistant Examiner*—André L. Jackson
(74) *Attorney, Agent, or Firm*—Manabu Kanesaka

(57) ABSTRACT

A damping mechanism for an opening and closing member that opens and closes an opening while changing a center of rotation has an arm with damped rotational speed to support a shaft part of the opening and closing member. A position of the shaft part with respect to the arm is changed along with the opening and closing operation of the opening and closing member by a guide member. The arm is urged toward an opening direction of the opening and closing member by a forcing member, and the opening and closing member is maintained in a closed state against the force of the forcing member by a locking member.

9 Claims, 13 Drawing Sheets

DAMPING MECHANISM OF OPENING AND CLOSING MEMBER, AND CONTAINER HOLDER AND AUTOMOBILE DOOR INCLUDING THE SAME

BACKGROUND OF THE INVENTION AND RELATED ART STATEMENT

The present invention relates to a damping mechanism of an opening and closing member, such as a door or a lid body, that opens and closes, i.e. covers, an opening while changing the center of rotation, as well as a container holder and an automobile door provided with the same.

As an example of an opening and closing member that opens and closes an opening, such as a door or a lid body, the present applicant has previously proposed a container holder provided in a center console of an automobile, which is disclosed in Japanese Patent Application No. 2000374564. As shown in FIG. 13 and FIG. 14, the container holder is constituted by a main body 100 and a lid body 102, and a holding part (not illustrated) for holding a container provided on the main body 100 can be opened and closed by the lid body 102.

A pair of shaft support parts 102A is provided on both sides of the lid body 102. Also, shafts 108, 110 are respectively fixed to the shaft support parts 102A with a specific interval. The shafts are inserted into an arc-shaped guide hole 106 formed on the side of the main body 100, and they are capable of moving along the guide hole 106.

Also, a small sector gear 112 is coupled around the shaft 108, and a damping gear 114 is engaged with the small sector gear 112. Meanwhile, a sector gear 116 is coupled around the shaft 110, and a damping gear 120 is engaged with the sector gear 116.

Therefore, when the shaft 108 moves along an arc-shaped branch path 106A that branches upward from the guide hole 106, a force of an opening spring 118 is damped by the engagement between the small sector gear 112 and the damping gear 114. When the shafts 108, 110 move inside the guide hole 106, the force of the opening spring 118 is damped by the engagement between the sector gear 116 and the damping gear 120.

By this configuration, it is possible to damp the force of the opening spring 118 continuously from the start of opening to the completion of opening, even if the lid body 102 changes a movement track in the middle of the course. However, with a construction such as the above, two damping gears are provided and the mechanism becomes complex, thereby increasing a cost.

In consideration of the above situation, an object of the present invention is to provide a damping mechanism of an opening and closing member that is capable of damping from the start of opening to the completion of opening of an opening and closing member, as well as a container holder and an automobile door that include the same, the damping mechanism being inexpensive with a simple construction.

SUMMARY OF THE INVENTION

In the first aspect of the present invention, a damping mechanism of an opening and closing member that opens and closes an opening while changing the center of rotation has an arm with a damped rotational speed to support a shaft part of the opening and closing member. A position of the shaft part with respect to the arm is changed along with the opening and closing operation of the opening and closing member by guide means. Meanwhile, the arm is urged toward an opening direction of the opening and closing member by forcing means, and the opening and closing member is maintained to be in a closed state against the force of the forcing means by locking means.

The damping mechanism of the opening and closing member has the arm having the damped rotational speed, and the position of the shaft part with respect to the arm is changed along with the opening and closing operation of the opening and closing member. Therefore, it is possible for the arm to rotate continuously from the start of opening to the completion of opening of the opening and closing member, even when the opening and closing member changes the center of rotation.

Through this configuration, it is possible to utilize the damping force working on the arm continuously during the time from the start of rotation to the completion of rotation of the opening and closing member in which the center of rotation varies. Therefore, the opening and closing member can be opened quietly by damping the force of the forcing means that urges the opening and closing member toward the opening direction.

Accordingly, even when the opening and closing member changes the center of rotation, because it is not necessary to provide plural damping members such as oil-sealed type rotation dampers according to the shift of the center of rotation, the mechanism can be simplified and a cost can be reduced.

In the second aspect of the present invention, a shaft part includes the first shaft provided on each end of the opening and closing member and the second shaft provided with a specified interval from the first shaft.

Also, the guide means comprises a guide part. Through this guide part, the first shaft rotates around the second shaft as the opening and closing member is opened from the start of opening of the opening and closing member to a specified angle. Also, the second shaft and the first shaft are moved on the same track as the opening and closing member is opened from the specified angle to the completion of opening of the opening and closing member.

Here, the arm is provided with the first long hole part, and the first shaft slides in the first long hole part around the second shaft from the start of opening of the opening and closing member to the specified angle.

Therefore, in addition to a damping force working on the arm, sliding resistance is applied to the first shaft as the first shaft slides in the first long hole part, thereby increasing the damping force for damping the force of the forcing means.

In the third aspect of the invention, the second long hole part is provided on the arm to allow a movement of the arm without being constrained by the second shaft when the first shaft slides in the first long hole part from the start of opening of the opening and closing member to the specified angle.

Through this configuration, the arm can rotate via the second long hole part relative to the second shaft when the first shaft slides in the first long hole part from the start of opening of the opening and closing member to the specified angle.

The arm is rotated continuously from the start of opening to the completion of opening of the opening and closing member, even though the center of rotation from the start of opening of the opening and closing member to the specified angle is different from that from the specified angle to the completion of opening. Therefore, it is possible to utilize the damping force of the arm itself.

Also, because the sliding resistance is applied to the first shaft as the first shaft slides in the first long hole part from the start of opening of the opening and closing member to the specified angle, the damping force for damping the force of the forcing means can be increased.

In the fourth aspect of the invention, the container holder has the damping mechanism of the opening and closing member as described in the first or second aspect of the invention. Thus, because the force of the forcing means can be continuously damped during the time from the start of opening to the completion of opening of the lid body of the container holder as the opening and closing member, the lid body can be opened quietly during the opening and the container holder can possess a sense of high quality.

In the fifth aspect of the invention, an automobile door has the damping mechanism of the opening and closing member as described in the first or second aspect of the invention. Thus, because the force of the forcing means can be continuously damped during the time from the start of opening to the completion of opening of the automobile door as the opening and closing member, the door can be opened quietly during the opening and the automobile can possess a sense of high quality.

BRIEF DESCRIPTION OF THE DRAWINGS

FIGS. 2(A) and 2(B) are sectional views of a latch device for maintaining a closed state of the lid body provided on the container holder with the damping mechanism of the opening and closing member, wherein FIG. 2(A) shows a locked state of the hook part and the catch part, and FIG. 2(B) shows an unlocked state of the hook part and the catch part;

DETAILED DESCRIPTION OF PREFERRED EMBODIMENTS

Figure 1:
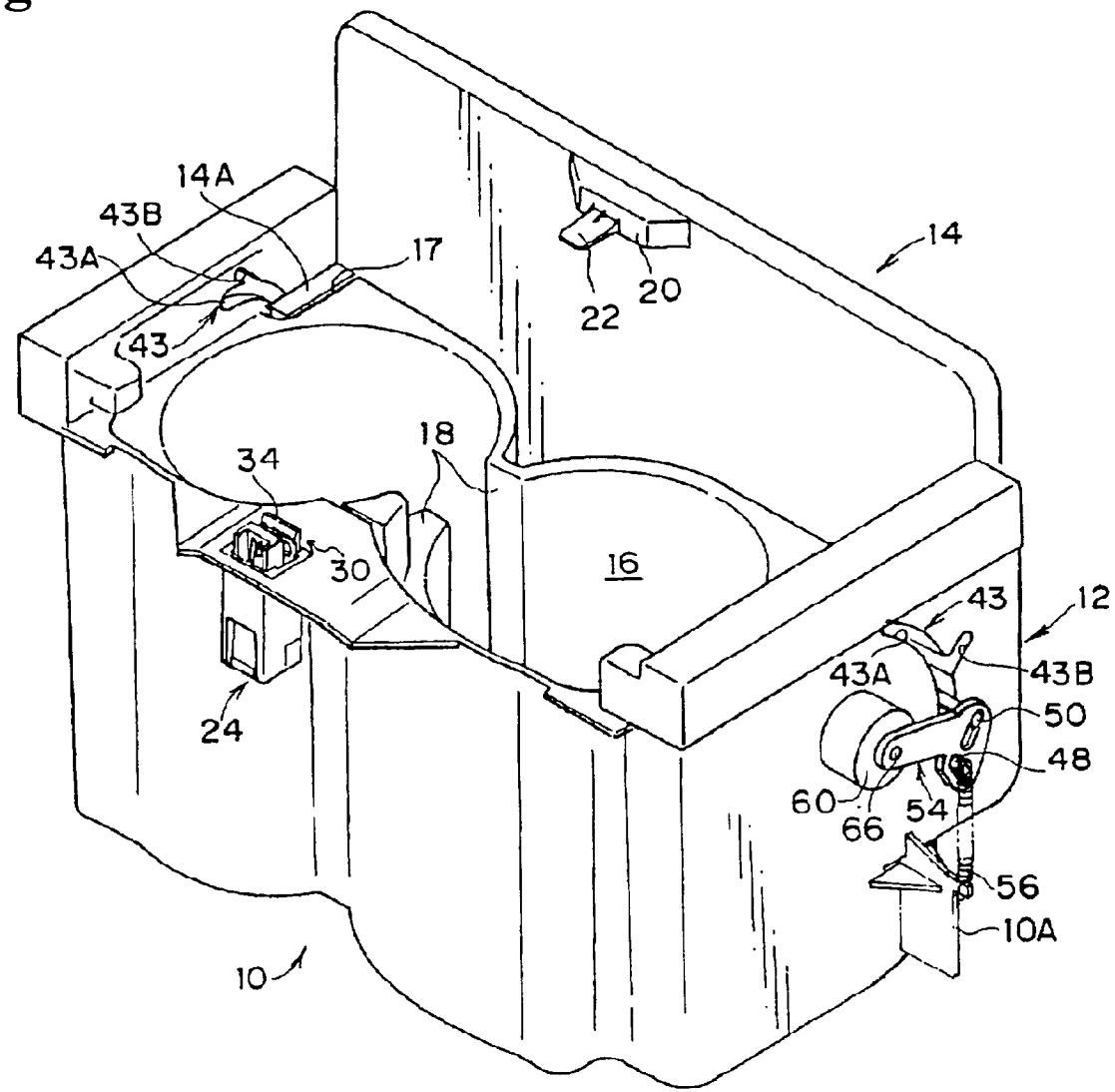
FIG. 1 is a perspective view showing a container holder with a damping mechanism of an opening and closing member according to an embodiment of the present invention.
Figure 3:
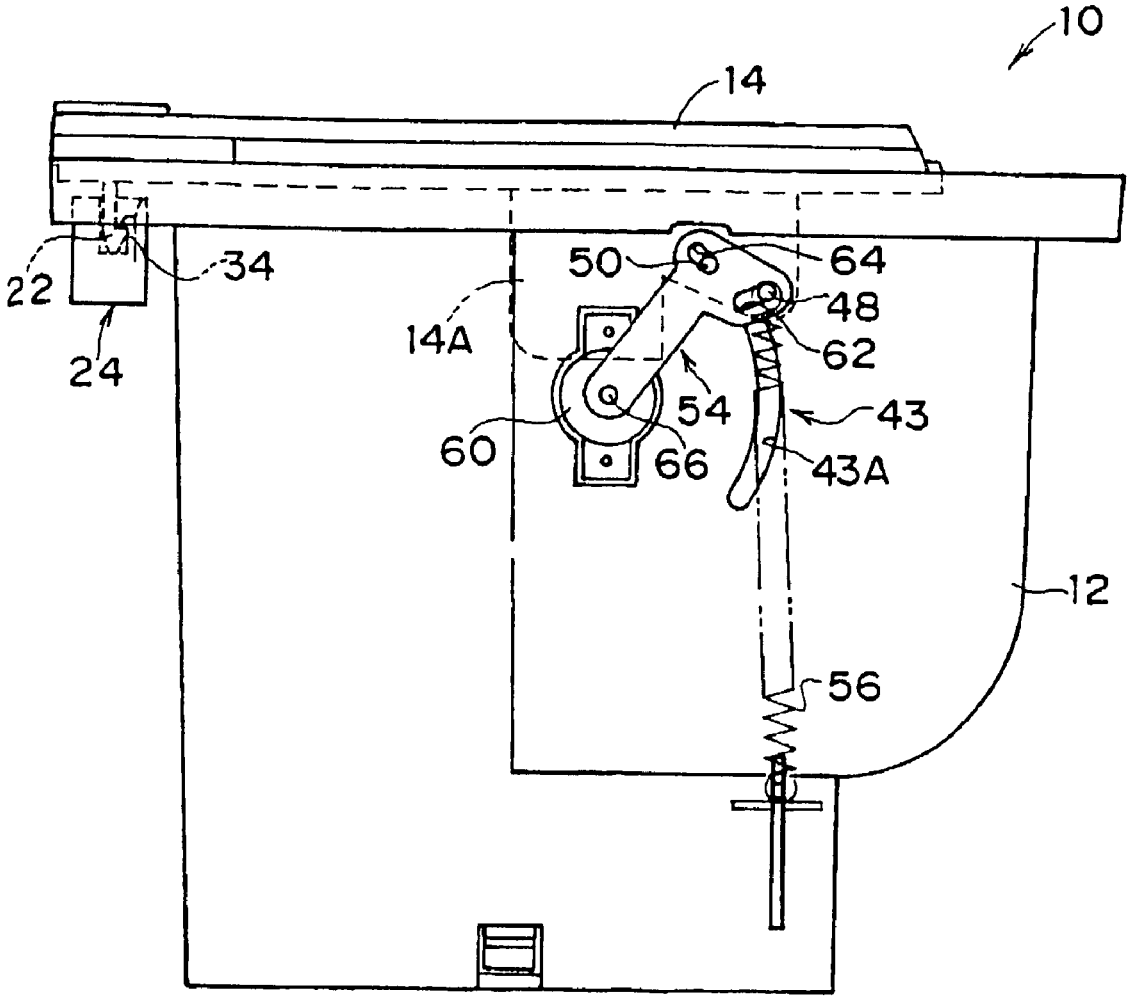
FIG. 3 is a side view showing the closed state of the lid body provided on the container holder with the damping mechanism of the opening and closing member of the invention.

FIG. 1 and FIG. 3 show a container holder 10 with a damping mechanism according to an embodiment of the present invention. The container holder 10 is placed in a center console disposed between a driver seat and a front passenger seat of an automobile (not illustrated), and is capable of being housed inside a recessed part (not illustrated) provided in the center console.

The container holder 10 is formed of a main or case body 12 and a lid body 14. A pair of shaft support plates 14A is provided on both sides of the lid body 14, and shafts 48, 50 are fixed respectively to the shaft support plates 14A with a predetermined interval therebetween.

Holding parts 16 are provided in the main body 12 so as to be capable of holding containers with a large external dimension, such as a PET bottle. The lid body 14 is arranged to be able to open and close, i.e. cover, the holding parts 16. At the center of the holding parts 16 in the longitudinal direction, mountain-shaped supporting parts 18 are provided to face each other toward the inside. The supporting parts 18 support the containers so as not to turn sideways.

Also, a pair of receiving parts 17 is cut out, each being formed between a rear side of the holding part 16 and a sidewall of the main body 12. Shaft support plates 14A are capable of being disposed at the receiving parts 17, thus the shaft support plates 14A can be placed inside the sides of the main body 12, and the container holder 10 can be made small.

Further, at the center of a free end of the lid body 14, a pedestal 20 is placed sticking out on a backside of the lid body 14, and a hook part 22 is placed upright from this pedestal 20. The hook part 22 is capable of coupling with a latch device 24 provided on a side of the main body 12. As the latch device 24, for example, the one described in Japanese Patent Publication No. 08-282382 previously proposed by the present applicants can be used.

Figure 2B:
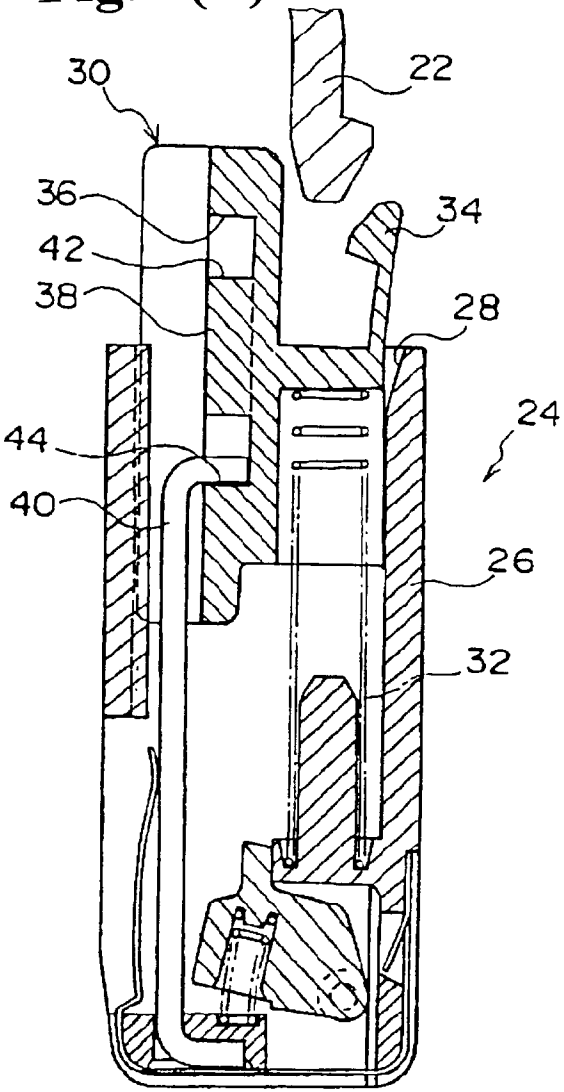
Figure 2A:
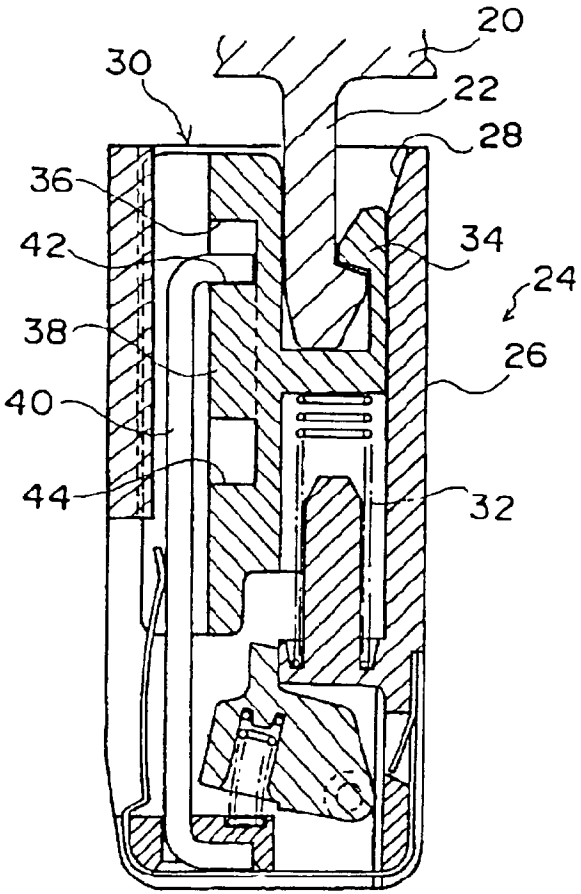

Specifically, as shown in FIGS. 2(A) and 2(B), an opening 28 is provided on the case 26 of the latch device 24 so that the hook part 22 can be inserted. The latch main body 30 is housed inside the case 26, and the latch main body 30 is urged toward a direction ejecting out from the opening 28 by a spring 32 disposed inside the case 26.

Also, a catch part 34 being capable of coupling with the hook part 22 is provided on a front end of the latch main body 30. The hook part 22 is locked by the catch part 34, while the latch main body 30 is received inside the case 26.

Also, a recessed part 36 is provided on the backside of the catch part 34 in the latch main body 30. A cam 38 with a roughly heart shape when viewed from the front is provided inside the recessed part 36. A lock lever 40 provided at a back end of the latch main body 30 so as to be capable of swaying slides along an outer perimeter of this cam 38.

When the latch main body 30 in the state jumping out from the opening 28 is pushed toward a direction against the force of the spring 32 so as to be received inside the case 26, the lock lever 40 traces the outer perimeter of the cam 38 and is checked by a checking part 42, thereby maintaining the locked state of the hook part 22 and the catch part 34 (see FIG. 2(A)).

From this state, when the latch main body 30 is pushed toward the direction against the force of the spring 32, the lock lever 40 is released from the checked state. Then, the lock lever 40 traces the outer perimeter of the cam 38 and is checked by a checking part 44, and the hook part 22 and the catch part 34 are released from the locked state (see FIG. 2(B)).

Through the configuration described above, the lid body 14 is closed when the center on the free end of the lid body 14 is pressed to lock the hook part 22 and the catch part 34. When the center on the free end of the lid body 14 is pressed again in the closed state of the lid body 14, the locked state between the hook part 22 and the catch part 34 is released, and the lid body 14 is opened.

Next, essential components of the container holder 10 with the damping mechanism according to the embodiment of the invention are explained.

Figure 4:
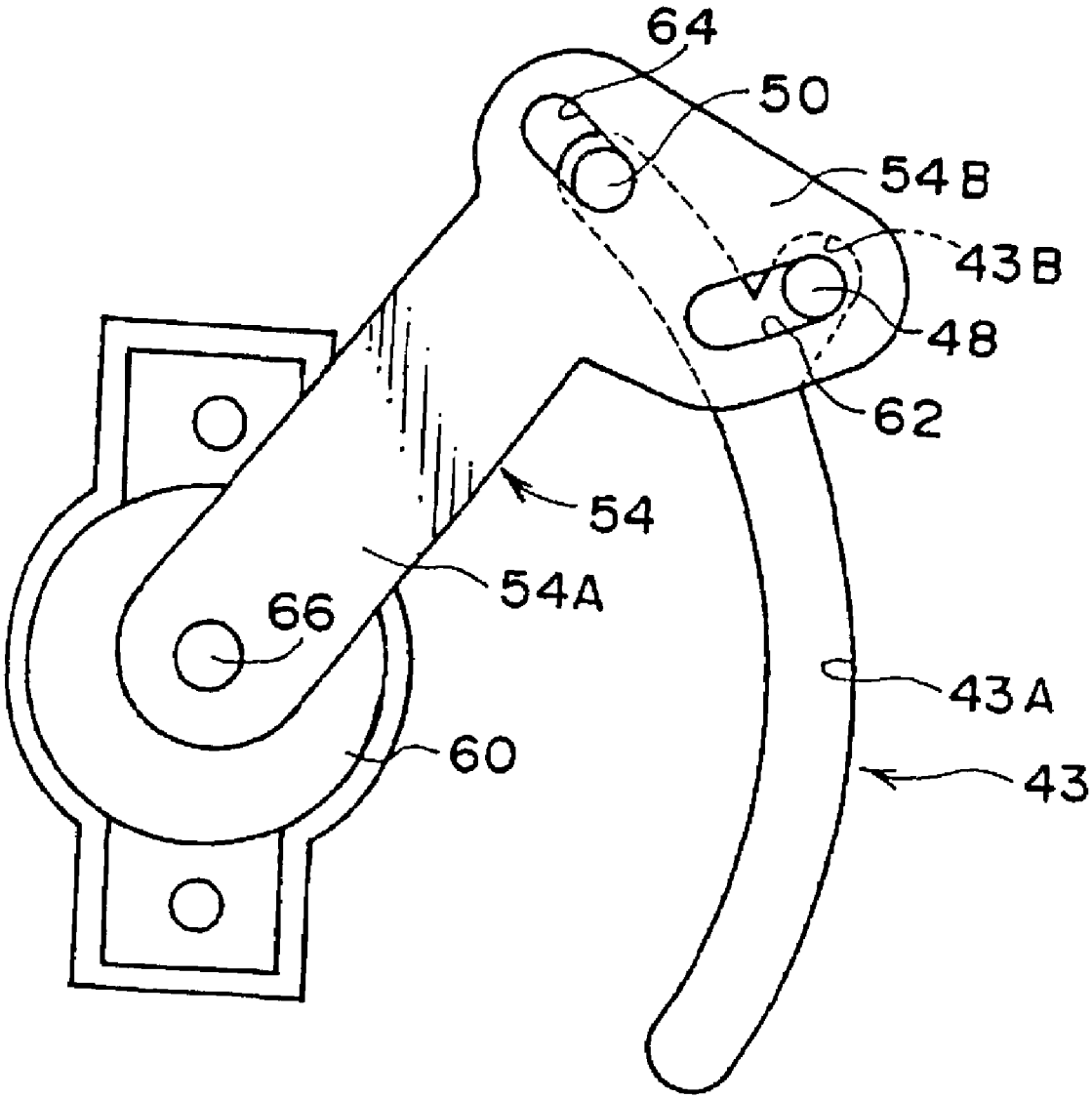
FIG. 4 is an enlarged view of FIG. 3 showing the damping mechanism of the opening and closing member of the invention.

As shown in FIG. 3 and FIG. 4, an arc-shaped guide part 43 is provided on each side of the main body 12. The guide part 43 is formed of a guide hole 43A in which a shaft 48 (first shaft) and a shaft 50 (second shaft) are inserted so as to be capable of moving, and a branch path 43B that branches upward from the guide hole 43A and runs diagonally upward in a direction away from the center of the arc of the guide hole 43A. The shaft 48 is inserted into the branch path 43B so as to be capable of moving.

Also, an oil-sealed type rotation damper 60 is disposed on each side of the main body 12. A rotating shaft 66 is provided at the center of the rotation damper 60, and a handle part 54A of a substantially L-shaped arm 54 is fixed to the center of the rotation damper 60. The rotation damper 60 damps a rotational speed of the arm 54.

Two long hole parts 62 (the first long hole part) and 64 (the second long hole part) are provided on a wide area part 54B of the arm 54 with a predetermined distance therebetween, and are placed roughly perpendicular to each other. The shaft 48 is inserted into the long hole part 62, and the shaft 50 is inserted into the long hole part 64.

Here, an external diameter of the shaft 48 and a width of the long hole part 62 are formed to be substantially the same. When the shaft 48 moves in the long hole part 62, the shaft 48 moves while rubbing against the perimeter of the long hole part 62. Also, an external diameter of the shaft 50 and the width of the long hole part 64 are formed to be substantially the same. Thus, when the shaft 50 moves in the long hole part 64, the shaft 50 moves while rubbing against the perimeter of the long hole part 64.

Incidentally, one end of an opening spring 56 is attached to the tip of the shaft 48, and the other end of the opening spring 56 is fixed to an attachment piece 10A projecting from the outside wall of the main body 12, thereby urging the lid body 14 toward the opening direction via the shaft 48.

Therefore, when closing the lid body 14, a load in the direction against the force of the opening spring 56 is applied to the lid body 14 by pressing the lid body 14. The shafts 48, 50 are moved following the guide part 43, and the arm 54 is caused to rotate via the shafts 48, 50. The lid body 14 is guided toward the close direction. Then, as shown in FIG. 5 and FIG. 6, in a state that the shaft 50 abuts against an edge of the guide part 43, the hook part 22 of the lid body 14 approaches the tip of the latch main body 30.

From this state, when the lid body 14 is pressed again, as described previously, the latch main body 30 shown in FIG. 2 is received inside the case 26, and the lock lever 40 is checked by the checking part 42. At this time, in parallel, as shown in FIG. 3 and FIG. 4, the shaft 48 slides in the long hole part 62 of the arm 54 around the shaft 50, and the lid body 14 is closed.

Figure 6:
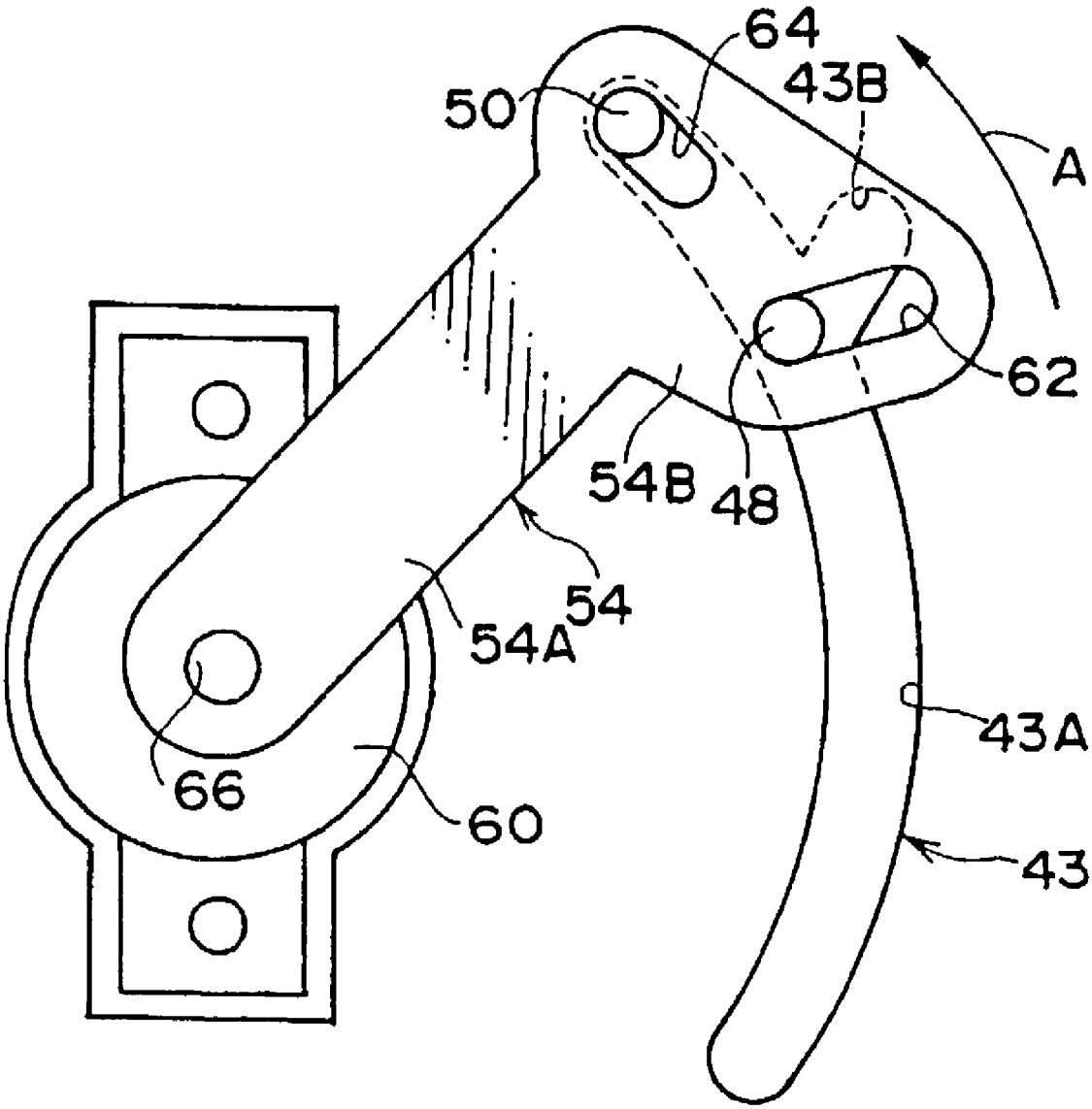
FIG. 6 is an enlarged view of FIG. 5 showing the damping mechanism of the opening and closing member of the present invention.
Figure 7:
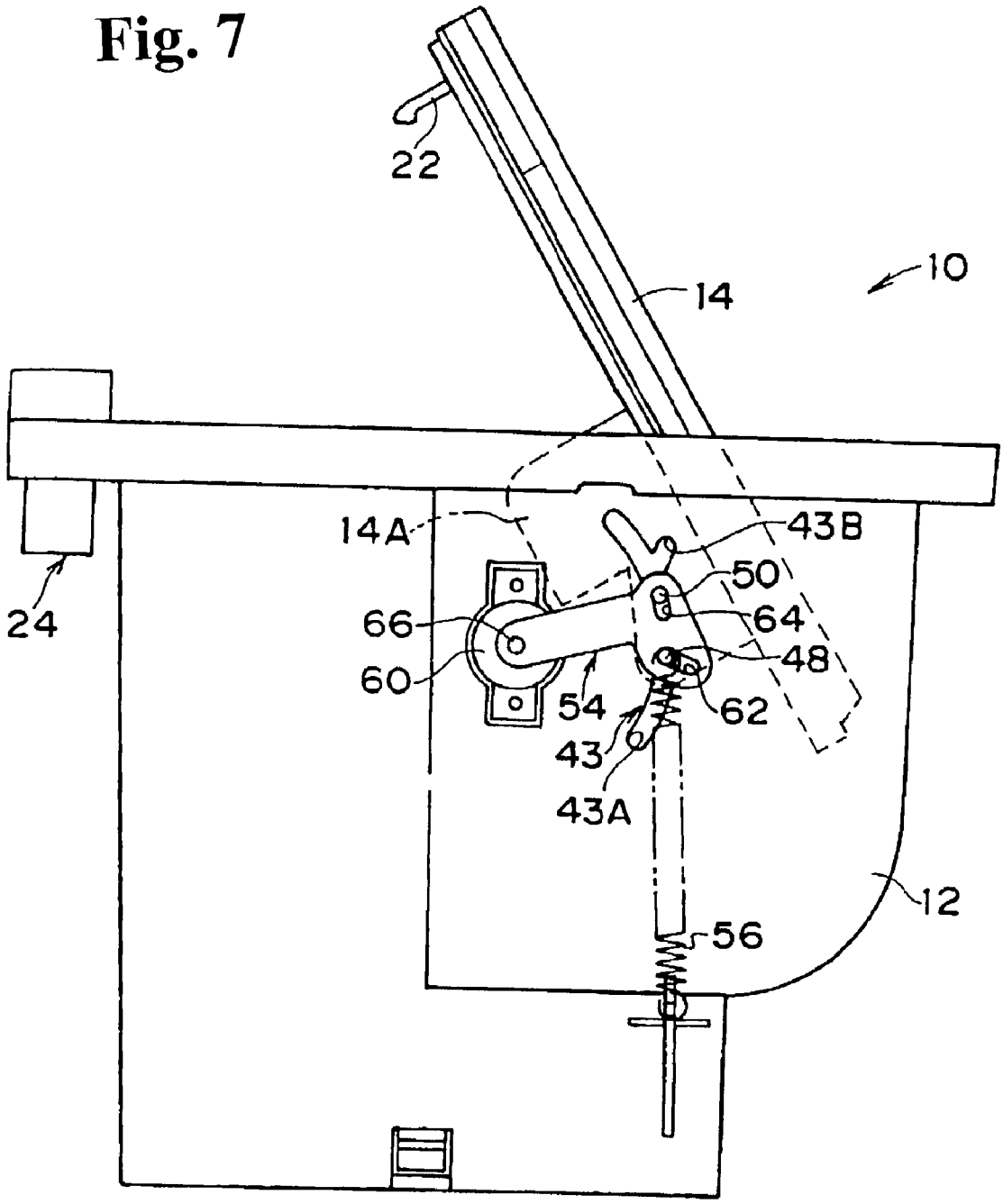
FIG. 7 is a side view showing a state that the lid body provided on the container holder with the damping mechanism of the opening and closing member opens at an angle greater than the specified angle.
Figure 8:
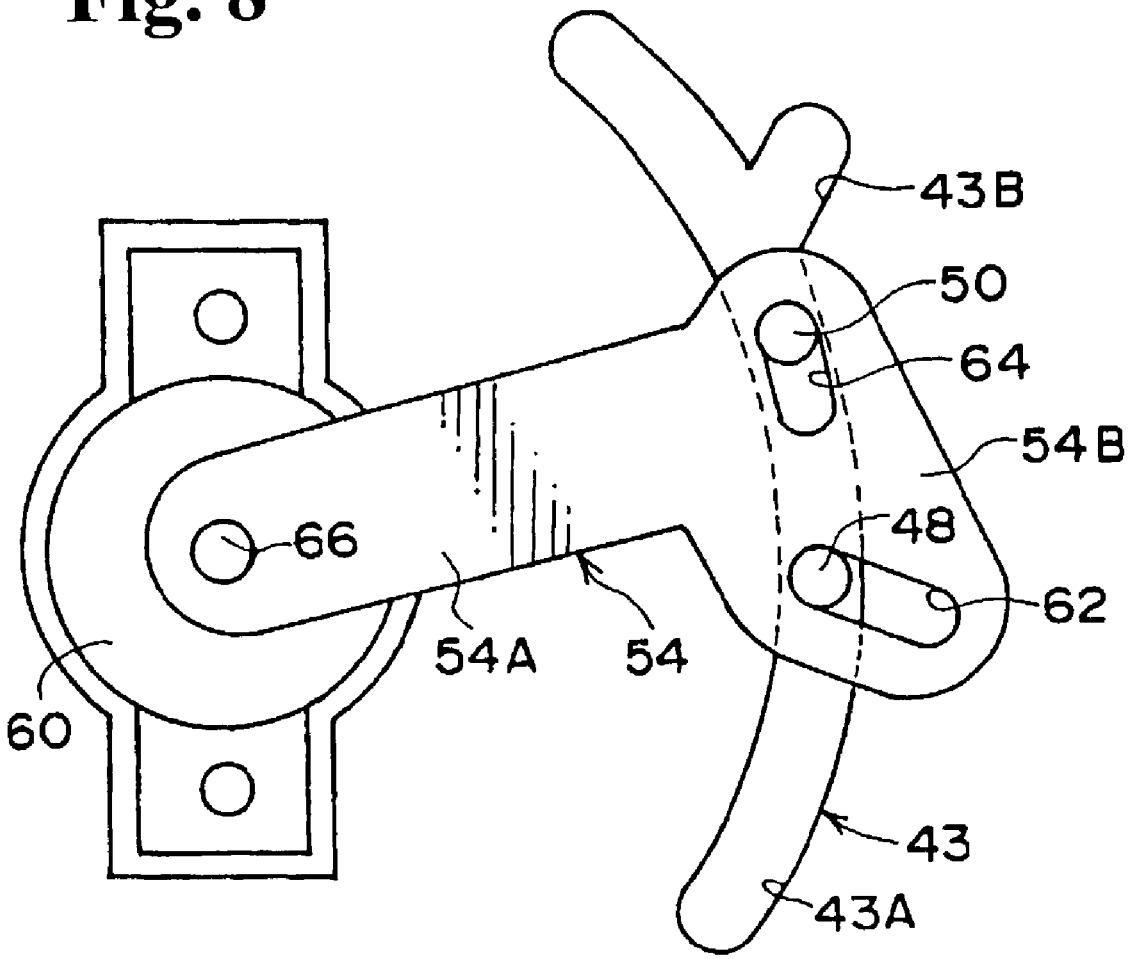
FIG. 8 is an enlarged view of FIG. 7 showing the damping mechanism of the opening and closing member of the present invention.

Here, because the branch path 43B is formed diagonally upward as shown in FIG. 4 and FIG. 6, the arm 54 attempts to rotate in the arrow direction A accompanying the movement of the shaft 48. At this time, through the long hole part 64 formed on the arm 54, the arm 54 can move relative to the shaft 50 via the long hole part 64, and the arm 54 rotates in the arrow direction A.

Figure 5:
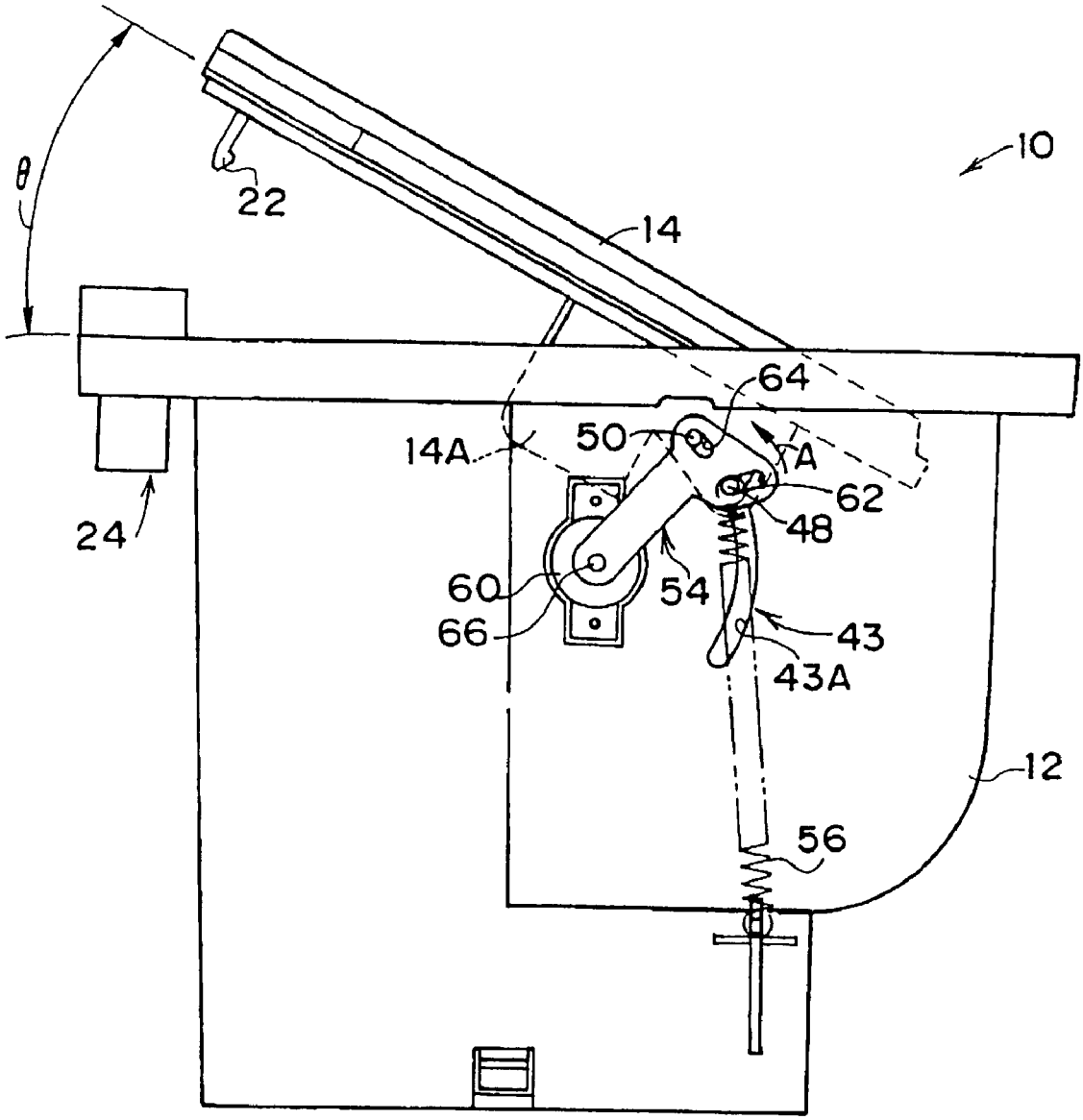
FIG. 5 is a side view showing a state that the lid body provided on the container holder with the damping mechanism of the opening and closing member opens at a specified angle.

On the other hand, when the center of the free end of the lid body 14 is pressed in the closed state of the lid body 14, the locked state between the hook part 22 and the catch part 34 (see FIG. 2(B)) is released as shown in FIG. 5 and FIG. 6.

At this time, the shaft 48 slides around the shaft 50 inside the long hole part 62 formed on the arm 54, and the lid body 14 opens at a specific angle θ (here, θ=27°). Since the shaft 48 slides inside the long hole part 62, the shaft 48 receives the sliding resistance, thereby damping the force of the opening spring 56.

Also, when the shaft 48 slides inside the long hole part 62 accompanying the movement of the shaft 48, the arm 54 can move relative to the shaft 50 through the long hole part 64 formed on the arm 54, and the arm 54 rotates in a direction opposite to the arrow direction A.

Therefore, because it is possible to utilize not only the sliding resistance when the shaft 48 slides inside the long hole part 62, but also the sliding resistance when the long hole part 64 slides relative to the shaft 50, as well as the damping force of the arm 54 itself, the damping force for damping the force of the opening spring 56 can be increased. Therefore, when the locked state between the hook part 22 and the catch part 34 (see FIG. 2(B)) is released, it is possible to prevent the lid body 14 from jumping out.

Next, as shown in FIG. 5 and FIG. 6, when the shaft 48 reaches the end of the long hole part 62, the lid body 14 is automatically opened by the force of the opening spring 56. At this time, as shown in FIG. 7 to FIG. 10, the shaft 48 and the shaft 50 move around the rotating shaft 66 on the same track following the guide hole 43A of the guide part 43. Then, the arm 54 rotates via the shafts 48, 50, and the lid body 14 is completely opened.

Here, because the arm 54 is fixed to the rotating shaft 66 of the rotation damper 60, the rotational speed of the arm 54 is damped. Therefore, because the lid body 14 is opened with the rotational speed damped, the lid body is opened quietly and a sense of high quality is obtained.

Figure 9:
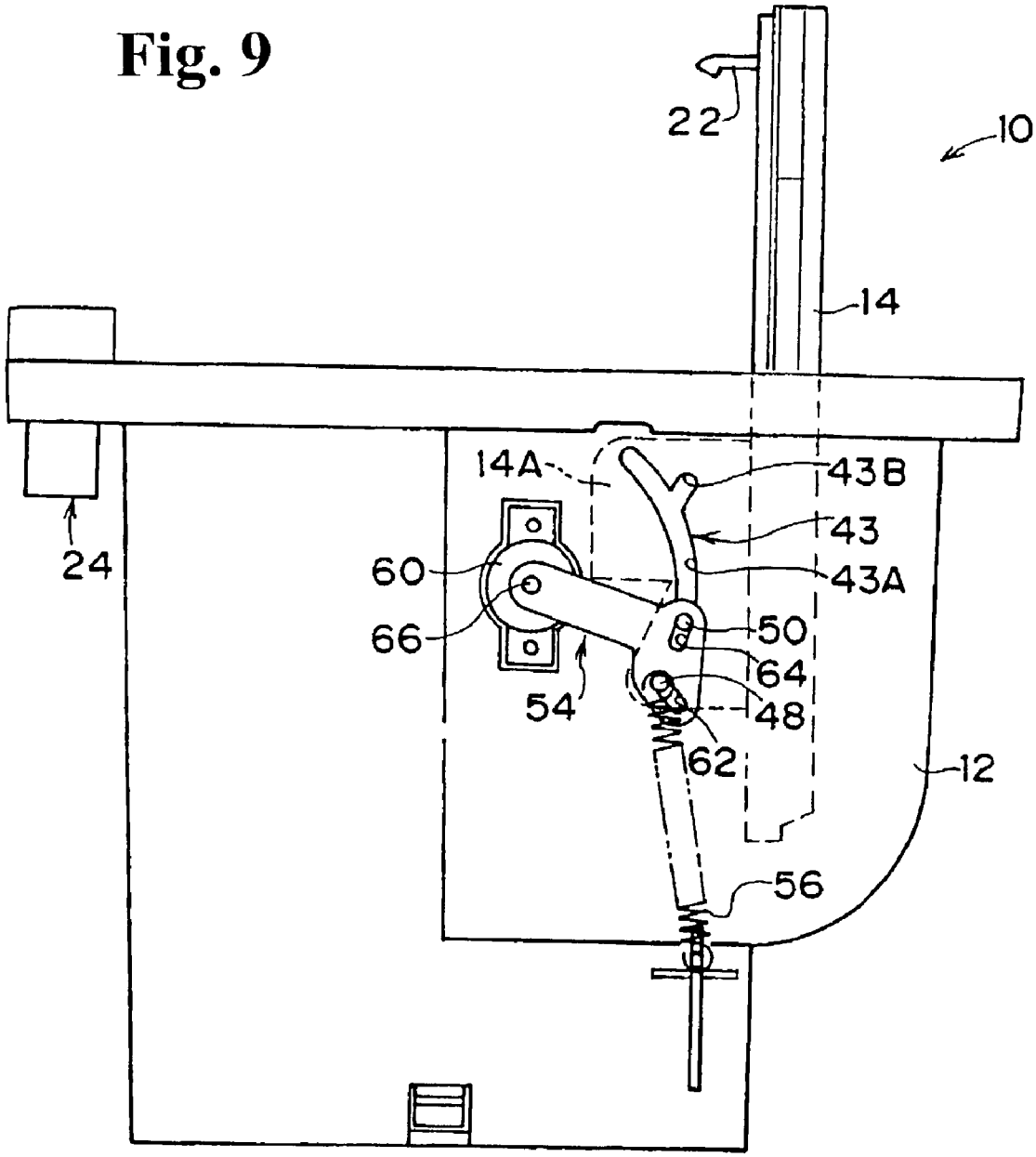
FIG. 9 is a side view showing a state that the lid body provided on the container holder with the damping mechanism of the opening and closing member opens completely.
Figure 10:
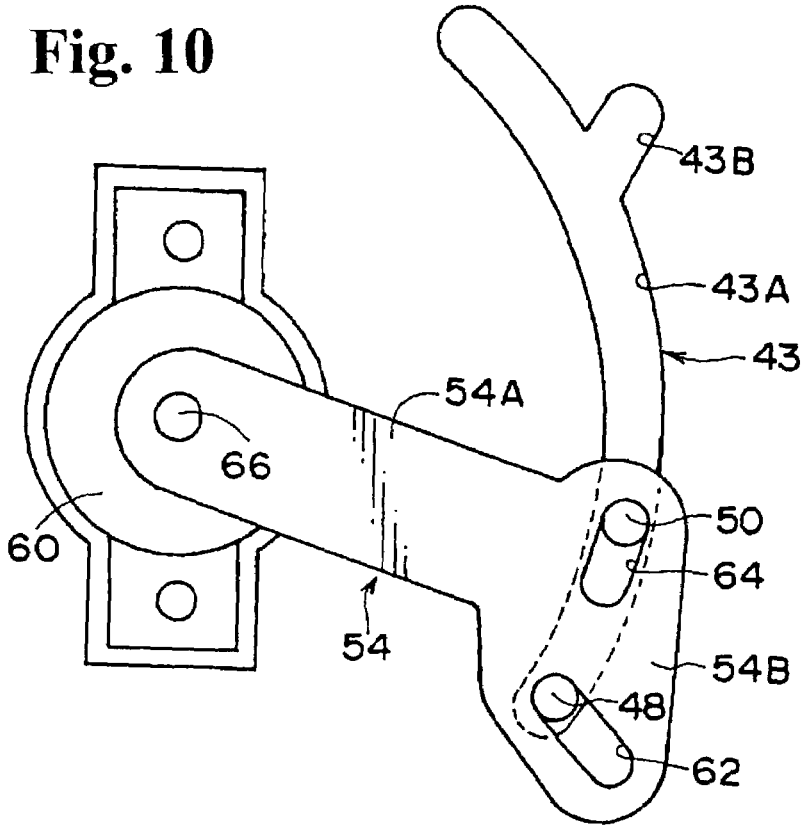
FIG. 10 is an enlarged view of FIG. 9 showing the damping mechanism of the opening and closing member of the present invention.

Also, by changing the moving track of the lid body 14 in the middle, when the lid body 14 is opened, the opened lid body 14 can be stored behind the main body 12 such that the lid body 14 does not become an obstacle (see FIG. 9).

Through the constitution described above, even when the lid body 14 changes the center of rotation, because the force of the opening spring 56 can be damped continuously from the start of opening (see FIG. 3) to the completion of opening (see FIG. 9) of the lid body 14 by the damping force working on the arm 54 and the sliding resistance working on the shafts 48, 50, the lid body 14 can be opened quietly.

Also, the long hole part 62 is formed on the arm 54, and the shaft 48 slides inside the long hole part 62. Thus, the sliding resistance damps the force of the opening spring 56. In addition, the long hole part 64 is formed on the arm 54, and the arm 54 can move relative to the shaft 50 within the fixed open angle θ of the lid 14 via the long hole part 64. Thus, the arm 54 can rotate while utilizing the damping force of the arm 54 itself.

Therefore, despite the various rotational center locations, because it is not necessary to provide a damping member, such as a rotation damper other than the rotation damper 60, the mechanism is simple, and also a cost can be reduced.

Figure 11:
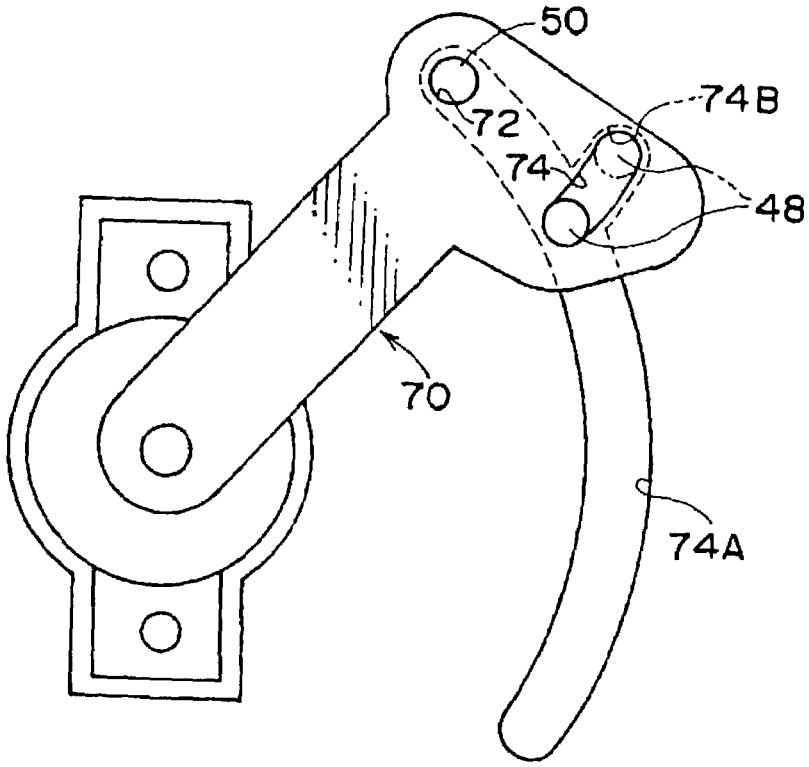
FIG. 11 is an enlarged view showing another example of the damping mechanism of the opening and closing member according to the embodiment of the present invention.

Here, it is configured such that when the shaft 50 reaches the end of the guide hole 43A, and the shaft 48 rotates around the shaft 50, the arm 54 rotates in the direction opposite to the arrow direction A accompanying the movement of the shaft 48, thereby utilizing the damping force of the arm 54 itself. However, the damping force of the arm 54 itself is not necessarily required. For example, as shown in FIG. 11, a round hole 72 and a long hole part 74 are formed on an arm 70, and the shaft 50 is inserted into the round hole 72. Also, a branch path 74B and the long hole part 74 are formed in an arc shape around the shaft 50.

Through this configuration, when the shaft 50 reaches the end of the guide hole 74A, the shaft 48 can rotate around the shaft 50 along the long hole part 74, and the lid body 14 (see FIG. 5) can be opened within the predetermined angle θ. At this time, by making the sliding resistance of the shaft 48 along the long hole part 74 greater, the force of the opening spring 56 (see FIG. 5) can be damped even without using the damping force of the arm 70 itself.

Also, as shown in FIG. 4, the external diameter of the shaft 50 and the width of the long hole part 64 are substantially the same such that the sliding resistance is obtained when the long hole part 64 slides relative to the shaft 50. However, this sliding resistance is not necessarily required, and the width of the long hole part 64 may be larger than the external diameter of the shaft 50 so that the shaft can move smoothly.

Figure 12:
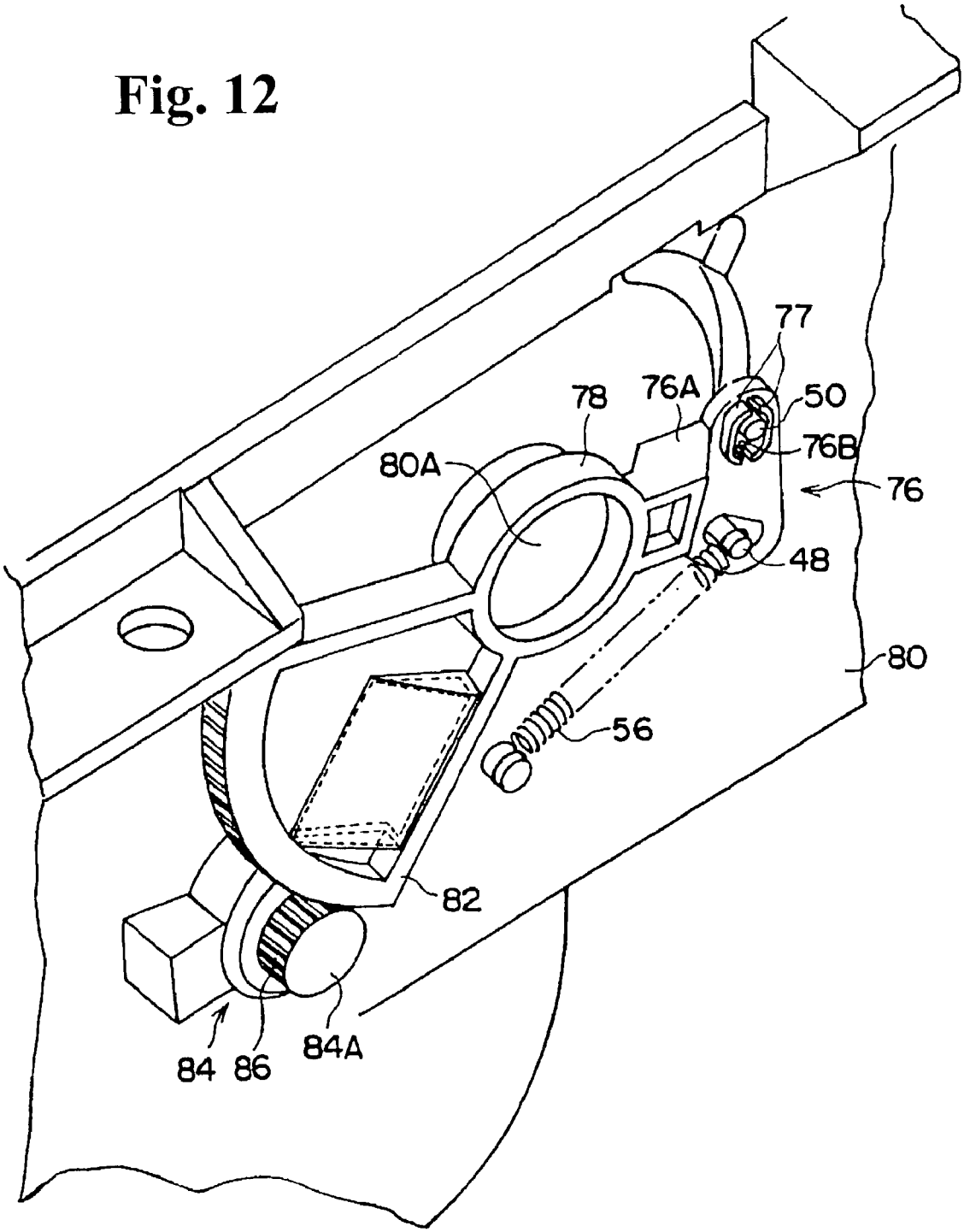
FIG. 12 is an enlarged view showing another example of the damping mechanism of the opening and closing member of the present invention.
Figure 13:
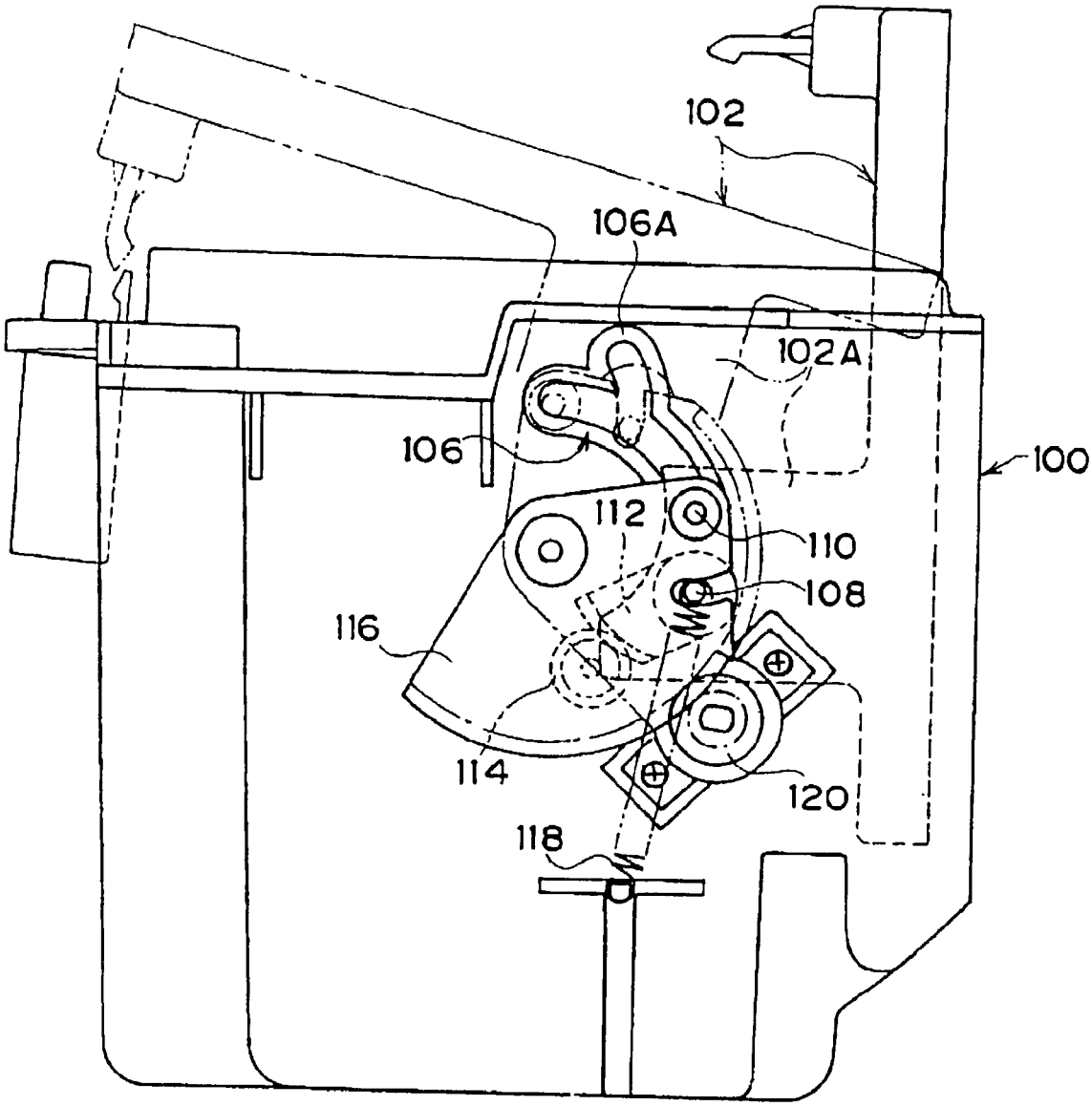
FIG. 13 is a side view showing a previous damping mechanism of an opening and closing member.
Figure 14:
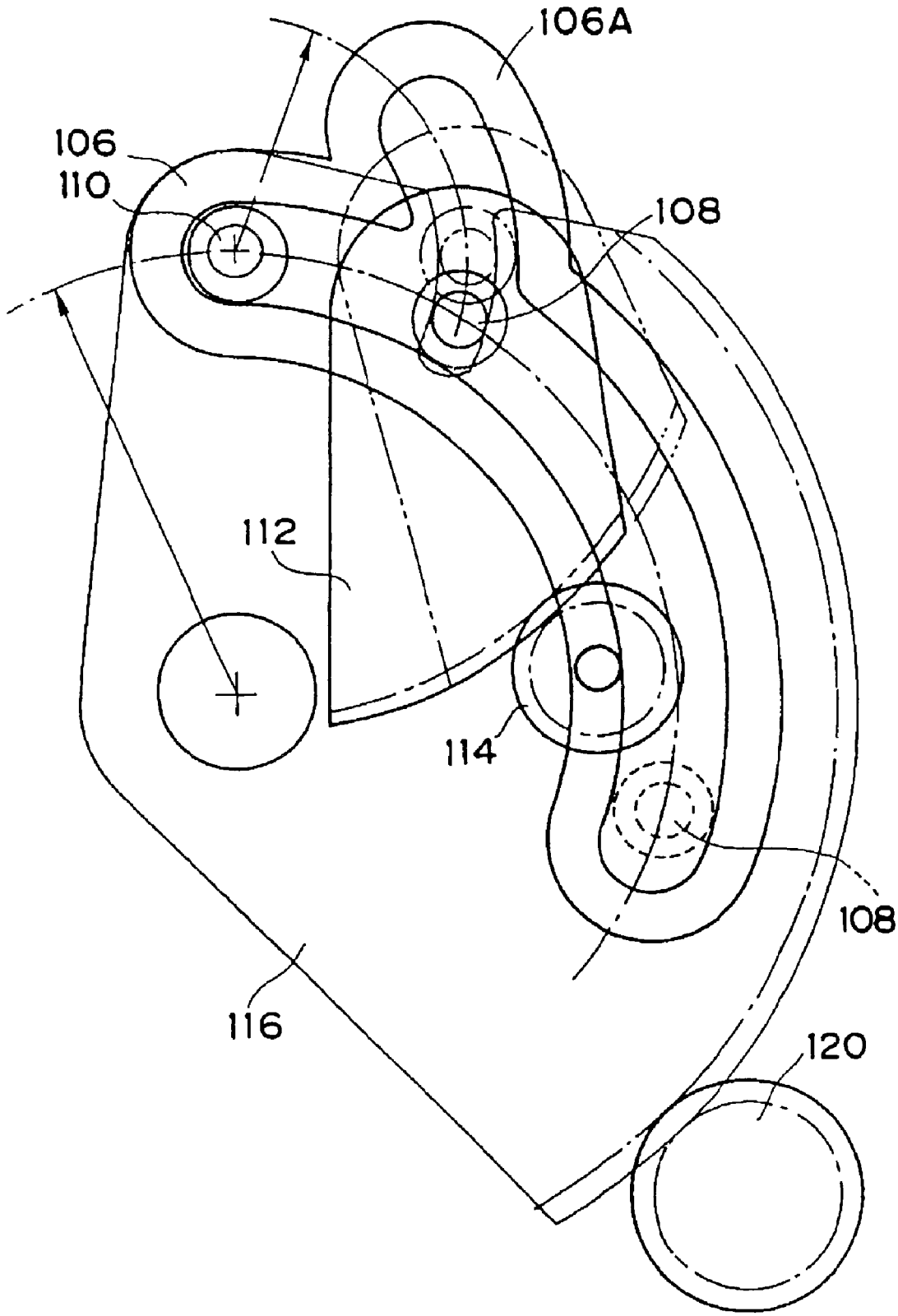
FIG. 14 is an enlarged view of FIG. 13 showing the previous damping mechanism of the opening and closing member.

Furthermore, as shown in FIG. 12, a reinforcing member 76A may be provided on an arm 76 to reinforce the arm 76 itself. Also, a rib 77 with substantially the same height as the tip of the inserted shaft 50 may be provided around a long hole part 76B in which the shaft 50 is inserted, so that one end of the opening spring 56 will not be attached to the shaft 50 when attaching to the tip of the shaft 48.

Also, in this embodiment, as shown in FIG. 3, the handle part 54A of the arm 54 is fixed to the rotating shaft 66 of the rotation damper 60 such that the rotational speed of the arm 54 is damped by the rotation damper 60. However, it is not limited to this configuration as long as the rotational speed of the arm 54 is damped.

For example, as shown in FIG. 12, a ring 78 is provided on the handle part of the arm 76, and a sector gear 82 is provided around the ring 78 on a side opposite to the arm 76. Also, the ring 78 is inserted into a shaft part 80A provided on a side surface of the main body 80 such that the arm 76 and the sector gear 82 can rotate around the shaft part 80A.

A gear 86 is provided on a rotating shaft 84A of a rotation damper 84 provided on the side surface of the main body 80 to engage the sector gear 82. Through this configuration, the rotational speed of the arm 76 is reduced, and the rotational speed of the arm 76 can be further damped in addition to the damping force due to the rotation damper 84.

Also, because the moment of force necessary to damp the arm 76 is the same, a distance between the shaft part 80A and the rotation damper 84 may be arranged to be greater than a distance between the shaft part 80A and the shafts 48, 50. Thus, as shown in FIG. 3, it is possible to damp the arm 76 (see FIG. 12) with smaller damping force compared with the case when the handle part 54A of the arm 54 is fixed to the rotating shaft 66 of the rotation damper 60.

Also, here, the damping mechanism of the opening and closing member applied to the container holder has been explained. However, it is not limited to the container holder as long as it is an opening and closing member that is opened while providing damping force. For example, it also may be applied to an automobile door.

The present invention is constituted as described above. In the first aspect of the invention, because it is possible to utilize the damping force working on the arm continuously during the time from the start of opening to the completion of opening of the opening and closing member while the center of rotation varies, the opening and closing member can be opened quietly by damping the force of the forcing means that forces the opening and closing member toward the open direction. Accordingly, even when the opening and closing member changes the center of rotation, because it is not necessary to provide plural damping members such as an oil-sealed type rotation damper according to the various rotational centers, the mechanism can be simplified and a cost can be reduced.

In the second aspect of the invention, because the damping force is applied to the first shaft not only by the damping force working on the arm but also by the sliding resistance as the first shaft slides in the first long hole part, the damping force for damping the force of the forcing means can be increased.

In the third aspect of the invention, the arm rotates continuously from the start of opening to the completion of opening of the opening and closing member, despite that the center of rotation from the start of opening of the opening and closing member to the predetermined angle is different from the center of rotation from the predetermined angle to the completion of opening. Thus, it is possible to utilize the damping force of the arm itself. Also, because the damping force is applied to the first shaft by the sliding resistance as the first shaft slides in the first long hole part from the start of opening of the opening and closing member to the predetermined angle, the damping force for damping the force of the forcing means can be increased.

In the fourth aspect of the invention, because the force of the forcing means can be continuously damped during the time from the start of opening to the completion of opening of the lid body of the container holder as the opening and closing member, the lid body can be opened quietly during the opening and the container holder can possess a sense of high quality.

In the fifth aspect of the invention, because the force of the forcing means can be continuously damped during the time from the start of opening to the completion of opening of the automobile door as the opening and closing member, the door can be opened quietly during the opening and the automobile can possess a sense of high quality.

While the invention has been explained with reference to the specific embodiments of the invention, the explanation is illustrative and the invention is limited only by the appended claims.

What is claimed is:

1. A damping mechanism for opening and closing an opening and closing member for a device with an opening, comprising:

a shaft part attached to each end of the opening and closing member and having a first shaft and a second shaft at a predetermined distance away from the first shaft, a rotatable arm adapted to be rotatably attached to said device to engage the shaft part for supporting the same and having a first long hole part engaging the first shaft and a second long hole part engaging the second shaft and arranged to incline relative to the first long hole part, forcing means for urging the arm toward an opening direction of the opening and closing member, locking means for holding the opening and closing member in a closed state relative to said device against a force of the forcing means, and guide means formed in said device and engaging the first and second shafts of the shaft part for changing a position of the shaft part relative to the arm according to a movement of the opening and closing member, said guide means having a first guide groove part and a second guide groove part communicating with the first guide groove part for moving the first and second shafts along a same track to open the opening and closing member from a predetermined angle to a completely open state thereof, said first shaft located in the first guide groove part rotating around the second shaft and moving along the first guide groove part and the first long hole part while the second shaft slides along the second long hole part so that the opening and closing member opens from a closed state thereof to the predetermined angle.

2. A damping mechanism according to claim 1, wherein said forcing means is a spring attached to one of the shaft part and the arm.

3. An automobile door comprising said damping mechanism according to claim 1.

4. A damping mechanism according to claim 1, further comprising a damper attached to the arm for damping a movement of the arm.

5. A damping mechanism according to claim 4, wherein said arm is arranged such that the arm rotates from a beginning to an end of a movement of the opening and closing member so that the damper operates from the beginning to the end of the movement.

6. A container holder comprising said damping mechanism according to claim 1.

7. A container holder according to claim 6, further comprising a case body as said device with the opening, and a lid as the opening and closing member, said damping mechanism being installed between the case body and the lid.

8. A damping mechanism according to claim 1, wherein said first and second long hole parts in the rotatable arm are inclined relative to each other such that when the first shaft is moved inside the first long hole part, the second shaft is moved inside the second long hole part.

9. A damping mechanism according to claim 8, wherein said first long hole part in the rotatable arm is inclined relative to the first guide groove part in a condition that the opening and closing member is located between the predetermined angle and the closed state, to thereby cause the rotatable arm to rotate when the second shaft rotates around its own shaft.

* * * * *